United States Patent [19]

Hale et al.

[11] 4,141,096

[45] Feb. 27, 1979

[54] METHOD AND MEANS FOR PRODUCING MOTION IN WATER BEDS

[76] Inventors: Harry O. Hale; Joyce A. Taylor, both of 11411 Jola Ave., Garden Grove, Calif. 92643

[21] Appl. No.: 836,296

[22] Filed: Sep. 26, 1977

[51] Int. Cl.[2] ..... A61H 1/00

[52] U.S. Cl. ..... 5/108; 5/370; 128/33

[58] Field of Search ..... 5/60, 105-108, 5/109, 366, 369-371; 128/1 R, 1 B, 33

[56] References Cited

U.S. PATENT DOCUMENTS

| | | | |
|---|---|---|---|
| 2,793,375 | 5/1957 | Wardell, Jr. | 5/105 |
| 3,849,812 | 11/1974 | Walsh | 5/108 |
| 3,872,526 | 3/1975 | Betts | 5/370 |
| 4,048,684 | 9/1977 | Korner et al. | 5/370 |

*Primary Examiner*—Casmir A. Nunberg

*Attorney, Agent, or Firm*—Grover A. Frater

[57] ABSTRACT

Motion is departed to the water in water beds by periodically lifting a region of the lower surface of the water bed mattress, said region being contained somewhere within the outer margins of the water bed. A water motion that is more uniform and more acceptable in practical applications is provided by lifting a region at least one of whose margins is not parallel with the plane of any of the sides of the water bed mattress. In a preferred embodiment, it is a triangular section of the bottom of the water bed that is lifted, and the lifting is accomplished by tilting that triangular section upwardly toward the upper wall of the apparatus and by accomplishing that tilting from the apex of the triangular region. In a refinement of the action, a means is provided for adjusting the lifting action in frequency or degree to achieve a relationship with the natural resonant frequency of water movement that produces a pleasant bed motion.

6 Claims, 5 Drawing Figures

METHOD AND MEANS FOR PRODUCING MOTION IN WATER BEDS

This invention relates to improvements in methods and means for producing motion in water beds.

BACKGROUND OF THE INVENTION

The water bed, in which the mattress is a water filled, pliant container, has gained wide acceptance. It has become a standard, readily available alternative to the spring mattress bed. The popularity of the water bed is based partly upon the fact that the water mattress, by Pascal's law, provides a more uniform supporting reaction over a wider area of the user's body. The popularity of the water filled mattress can also be attributed to the reaction offered by such a mattress to a user's movements. Upon being placed in motion, the water in a water bed is displaced such that it behaves like a resonant system comprised of a mass and spring interconnected in a low friction combination. While the oscillatory frequency of water movement depends upon the volume being moved, and while the development of standing waves in the mattress depends upon a number of variables, including the point at which input displacement of water is applied, the oscillatory frequency and the low order harmonics of that frequency are such that oscillatory motion through several cycles is experienced in response to many of the ordinary movements of the water bed user.

Not everyone wants a bed that imparts a feeling of movement. However, it is logical to assume that those who choose water beds over conventional mattresses, including very soft conventional mattresses, are looking for that kind of movement. It is also apparent that it is impossible for the water bed designer to find a design which will provide optimum results for all users. The size, and the weight, and even the number of users is unknown, and may differ from one case to another. Whatever the design in terms of length, width and thickness of the mattress, and in terms of volume of water, and the inclusion or absence of inner support structures and other variables, some user movement may be expected to produce water movement that induces a less than pleasant feeling for the user or for a bed partner. Also, in the ordinary water bed, water movement does not occur except as a reaction to user movement. That has been viewed as a deficiency, and some attempts have been made to provide more water movement by applying vibrators to the mattresses. Notwithstanding such attempts, it appears that the prior art does not include a satisfactory method or structure for imparting adequate movement to the water in a water bed in the absence of user movement.

SUMMARY OF THE INVENTION

It is an object of the invention to provide a means by which some motion can be imparted by the water in a water bed mattress independently of user movement in a way that imparts a pleasant and, for some, a euphoric feeling.

Another object of the invention is to provide a means in which the water is moved repetitively in a way that simulates a continuing motion similar to wave action.

Another object of the invention is to provide such a wave action in a selected degree that is relatively uniform regardless of the position assumed by bed users, but which will change in some degree as the user changes position to the end that the feeling of motion experienced by the user can be changed merely by changing position.

Another object of the invention is to provide a structure that can produce such results and which is easily installed and simple to operate.

These and other objects and advantages of the invention, which will become apparent upon reading of the description below, are realized in part by the provision of a platform of such size as to accommodate the lower wall of a water bed mattress arranged so that the mattress will lie generally horizontally. An inner region of the area of that platform is mounted for movement in a direction to lift part of the lower wall of the water bed mattress when the mattress is disposed on that platform. That is combined with means for lifting and lowering that region of the platform on a periodic basis. In the preferred arrangement, the lifting and lowering is accomplished at a uniform frequency. In one form of the invention, the platform is formed with a cutout or opening in a central region within its margin. A member disposed in or over that opening is movable in a direction that includes a vertical component whereby to lift and lower the mattress wall that overlies the opening. The direction and the velocity and the magnitude of water flow within the mattress is a function of the degree in which the mattress wall is lifted, the frequency of the lifting and lowering action, and the position of the region that is lifted. Those variables are also a function of the shape of the portion of the mattress that is lifted. If a region of the lower mattress wall that extends entirely from one side of the mattress to the other is lifted, the resulting water movement, and the feeling imparted to the bed user, is substantially different than the feeling that results when the region being lifted is less wide than the mattress. For a reason that is not clear, the motion that is imparted to the bed induces what is generally considered to be a better feeling when the region of the mattress wall that is lifted has a side lying in a plane that is not parallel to any of the side walls of the mattress. In that circumstance, water is driven both lengthwise and sideways within the mattress as that region is alternately lifted and lowered. The best mode thus far discovered for practicing the invention includes lifting and lowering a region of the lower wall of the mattress that includes a side that extends at an angle to the mattress sides and in which the lifting is accomplished by tilting up that region so that one edge of the region remains in the plane of the lower mattress wall while the opposite edges are lifted to a level above that plane. The best form yet devised employs a generally horizontally platform on which the water mattress rests. A triangular region of that platform is cut out at a position that would normally underlie a user's legs. The apex of the triangular cutout is at the head side of the platform. The base of the triangular section is generally parallel to the head and foot edge of the bed, or at least is perpendicular to the direction to which the user is expected to lie on the bed. A triangular member, which may comprise the cutout portion of the platform, is disposed in the cutout and is hinged to the platform at its apex. A means is provided for lifting and lowering the triangular insert so that it tilts upwardly from the plane of the platform to a position in which the base of the triangular insert is above that platform. The triangular portion is lifted by any suitable means, such, for example, as an electric motor coupled to the element that is to be tilted by an eccentric mechanism.

It is possible to find a frequency and a degree of tilting that is generally acceptable to most users. However, it has been discovered, and it is a feature of the invention, that the motion can be adjusted to make a single design suitable for a wide range of water bed sizes, and of user sizes, by altering either the frequency of rotation or the degree of lifting of the displaceable elements. That is a fortuitous finding because it means that adjustment can be accomplished simply by adjusting the degree of eccentricity in the connection between the motive means and the movable element. In view of that, an alternating current motor may be selected as the motive means, notwithstanding that such motors tend to operate at constant speeds. It is to be understood, however, that adjustability can be provided without changing the degree at which the lower wall of the mattress is displaced by providing a means for accomplishing lifting and lowering at different frequencies.

DRAWINGS

DESCRIPTION OF THE PREFERRED EMBODIMENT

Figure 1:
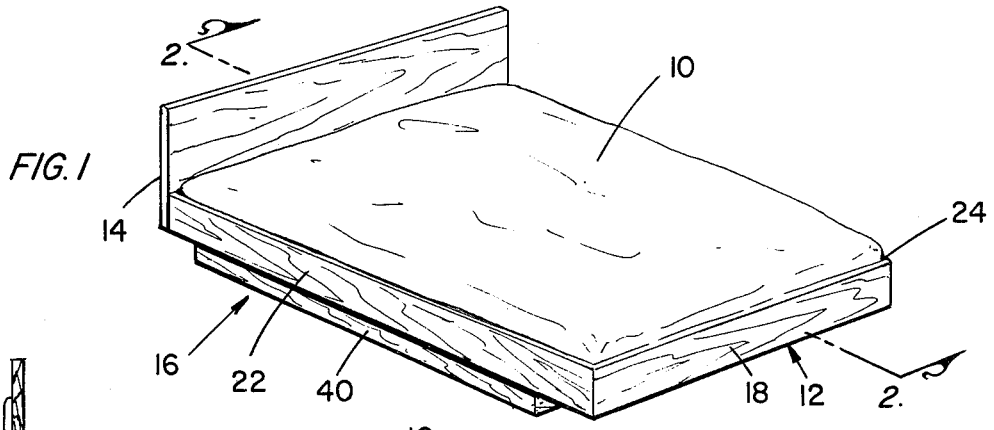
FIG. 1 is an isometric view of a water bed.

The water bed selected for illustration in FIG. 1 has a simple design, but, except for the inclusion of the invention, has a construction that is representative of most water beds. It comprises a water filled mattress 10 that is contained within a box-like frame 12 having a headboard 14 fixed to its head end. The box frame is supported by a supporting structure 16 which is barely visible at the side of the bed.

Figure 2:
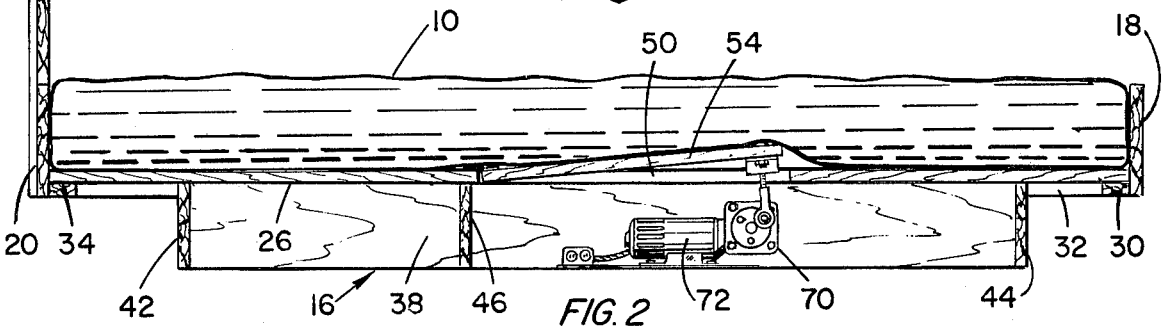
FIG. 2 is a cross-sectional view of the water bed taken on line 2—2 of FIG. 1.

The construction of the box frame can be understood by comparison of FIGS. 1 and 2. The frame has four side walls. The wall at the foot end of the bed is designated 18. The wall at the head end of the bed is designated 20. In FIG. 1, the near side wall is numbered 22. Just a small portion of the far side wall 24 is visible at the extreme left in FIG. 1. Those four sides stand vertically, and they are attached to a flat platform 26 which is visible in FIG. 2. The lower margins of the frame walls extend below the lower surface of the platform 26 and hide from view, except from below, supporting members that interconnect the side walls and the platform at the margins of the wall. Three of those supporting members are visible in FIG. 2 where they are numbered 30, 32 and 34, respectively. The member 30 is employed to reinforce the connection of the foot end wall 18 to the platform.

Member 34 is in the interconnection of the platform 26 with the head wall 20, and the longitudinally extending member 32 supports the interconnection of the platform 26 with the side far wall 24.

The mattress 10 is a water filled, pliant container. Its outside dimensions correspond generally to the overall dimensions of a conventional spring mattress. The body of water within the mattress is sufficiently heavy so that it is customary to support the platform 26 on which the mattress rests with a separate supporting structure. The structure shown in the drawings is a representative one. It is formed by four side walls interconnected to form a rectangle somewhat less long and less wide than the platform 26 which it supports. In this case, the supporting structure 16 is formed by a far side wall 38 which is visible in FIG. 2 and a near side wall 40 which is visible in FIG. 1. Both side walls are interconnected by a head end wall 42, a foot end wall 44, and an intermediate cross wall 46, all of which are visible in FIG. 2.

Figure 3:
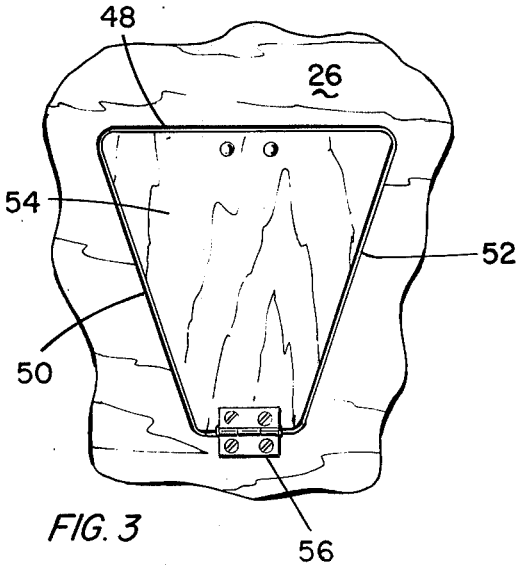
FIG. 3 is a top view of a fragment of the water bed with the water mattress removed.

Thus far described, the water bed shown in FIGS. 1 and 2 is conventional. However, it differs in that a triangular section of the platform 26 has been cut away. That triangular section is shown in top view in FIG. 3. It has the general shape of an isosceles triangle whose base is parallel with the head end and the foot end of the mattress 10. In the case of mattresses of other shapes, that triangular section would be arranged so that the base would extend in the direction generally perpendicular to the length of a user of the bed. The apex of the section begins near the center of the bed, and the cutout extends to the foot end of the bed so that it is positioned below that part of the mattress that would ordinarily support a user's legs. The drawing is arranged to indicate that the cutout, in this preferred embodiment, is located midway across the width of the bed.

The wall at the foot end of the cutout has been designated 48, and one of the side walls of the cutout is designated 50. The other side wall is designated 52. It will be apparent that the walls 50 and 52 extend at an angle to the side walls of the frame 12 and to the side walls of the mattress 10. Stated another way, the margins 50 and 52 lie in planes that are not parallel to the plane containing any of the side walls of the frame.

Figure 5:
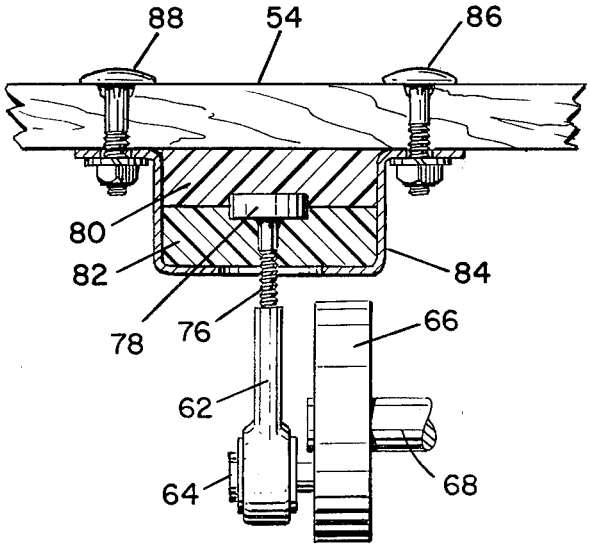
FIG. 5 is a fragmentary view, partly in cross-section, of the structure by which the drive motor is connected to the mattress lifting element.
Figure 4:
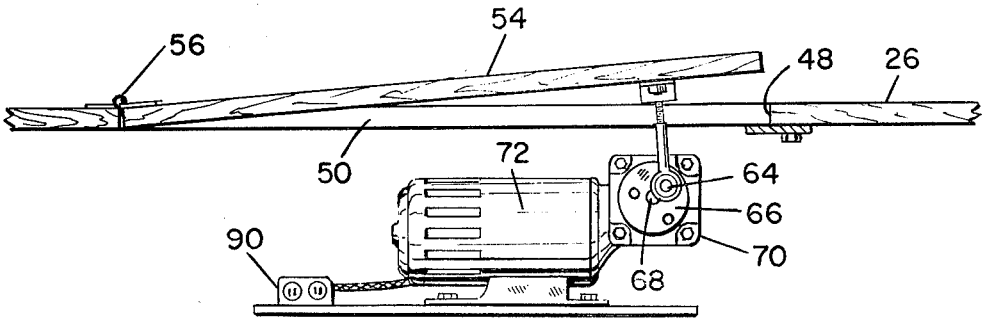
FIG. 4 is an enlarged view in side elevation of a portion of the bed shown in FIG. 2.

A means is provided by which a region of the lower portion of the mattress 10 can be lifted and lowered. In this preferred embodiment, that means is the triangular lifting member 54. In its lowered position, it fits within the cutout formed by walls 48, 50 and 52, and, indeed, it may comprise a portion of the platform 26 that was cut away to form the cutout. At its apex end, the lifting element 54 has pivotal connection to the platform 26 by a hinge 56. In FIGS. 2 and 4, the lifting element 54 is shown tilted up from the plane of the platform 26, but it will be apparent that the mechanism by which that tilting is accomplished is capable of lowering the lifting member 54 so that it lies entirely within the cutout of the platform 26 and is parallel with the platform. In this particular embodiment, a stop 60, shown in FIG. 4, is fastened to the underside of the platform 26 and extends across part of the cutout. It operates to limit downward movement of the lifting member 54 to a position parallel with the platform 26. That is not essential for two reasons. First, the invention is not limited to a lifting and lowering motion in which the lowering of the bottom wall of the mattress 10 is limited to the horizontal position. The invention may be practiced by lowering the lifting member 54 below the level of the platform 26. Secondly, the preferred drive mechanism illustrated in the drawings serves to limit the amount of upward movement and of downward movement of the lifting member 54. That lifting mechanism comprises an arm 62 the lower end of which is journalled to a shaft 64 as shown in FIG. 5. The end of that shaft is threaded into an opening in the outer face of a drive disc 66. The disc is mounted, at its central axis, upon the output shaft 68 of a reduction gear drive set 72 as shown in FIG. 2. The shaft 64 and the disc 66 combine to form a crank. As best shown in FIG. 4, the face of the disc 66 is provided with several openings in which the shaft 64 may be threaded. Each of those openings has a different distance from the center axis of the drive disc 66 whereby an adjustment of the length of the crank arm is possible.

In addition to the lower portion which is journalled to shaft 64 in FIG. 5, the lower part of arm 62 is internally threaded to receive an externally threaded extension rod 76 the upper end of which is fitted with a head, or transversely oriented disc, 78. That disc is trapped in a resilient coupling element comprising two blocks of resilient material numbered 80 and 82, respectively. The lower block has a central opening to accommodate arm extension 76, and the adjoining faces of the two blocks are cut away to accommodate the head, or disc, 78. The two blocks are held together by a bracket 84 which is generally U-shaped and has sidewardly extending extensions at its upper arms. Those extensions are bolted to the underside of the lifting element 54 by a pair of bolts 86 and 88. When the motor is powered electrically by power applied through box 90, as shown in FIG. 4, its output shaft rotates a reduction gear set in the unit 70. The output of that reduction gear set is rotation of shaft 68 and hence the crank formed by shaft 64 and disc 66. Rotation of the crank drives the arm 62 up and down and the arm acts through the coupling element to drive the lifting element 54 up and down.

If a direct current motor is employed at motor 72, motor speed and the frequency of operation of the lifting element 54 is easily adjusted. However, as previously explained, that is not essential. It is desirable that the input movement that results in water movement occur at a frequency near, but not at, the natural resonant frequency of water movement, or a sub-multiple of that frequency. But what that resonant frequency is is determined largely by the motion producing mechanism itself. It is entirely satisfactory to select an input frequency in the range of one to five seconds or more, and to adjust the degree of movement of the lifting element 54 to achieve whatever reflected wave action provides the most pleasant feeling.

While the triangular form of motion input element provides what is considered to be the best motion, that form is not the only one that is useful in the invention. It is advantageous to use an element whose sides are not parallel with the sides of the mattress so that there is a sideward component to the water motion. That does two things. It diminishes the possibility that the user will occupy a postion and have a wait that results in the development of large standing waves. In addition to that, it provides a gentle multiple direction motion which is not likely to become monotonous. The use of a triangular form in which the base of the triangle is parallel with the head and foot ends of the mattress serves to combine sideways motion with endwise motion of the water to the end that the resultant motion is uniform across the entire length and width of the bed.

It will also be apprent to the artisan that it is not essential that there be a cutout in the supporting platform. The element that does the lifting can be mounted above the platform and then driven through the platform. Moreover, it is not essential that that lifting element be one that tilts. Variations of that kind provide a new and beneficial action, although the preferred form is the one shown in the drawing.

Although we have shown and described certain specific embodiments of our invention, we are fully aware that many modifications thereof are possible. Our invention, therefore, is not to be restricted except insofar as is necessitated by the prior art.

We claim:

1. For a water bed, a support comprising in combination:

a platform of size to accommodate the lower wall of a water bed arranged for generally horizontal disposition;

a region of said platform being mounted for movement in a direction to tilt a portion of the lower wall of a water bed when disposed on said platform; and means for lifting and lowering said region of the platform by tilting it periodically;

said platform comprising a flat structure formed with an opening within its margins and said region of said platform comprising a member disposed over said opening and movable in a vertical direction relative to said flat structure;

said region of said platform having at least one edge wall lying in a plane which is not parallel to the plane of any edge wall of said flat structure.

2. The invention defined in claim 1 in which said opening and said region of said platform have generally triangular shape.

3. The invention defined in claim 2 in which said region of said platform has hinged connection to the remainder of the platform.

4. The invention defined in claim 3 in which said region of said platform has hinged connection to the remainder of the platform at the apex of its triangular form.

5. The invention defined in claim 1 in which said region of the platform is formed with a portion of varying width along its length.

6. The invention defined in claim 5 in which said portion of varying width is triangular and has hinged connection to said platform in the vicinity of its apex.

* * * * *